US006067775A

United States Patent [19]

O'Connor

[11] Patent Number: 6,067,775

[45] Date of Patent: May 30, 2000

[54] PACKAGING A STRIP OF MATERIAL BY FOLDING

[75] Inventor: Lawrence J. O'Connor, Winnipeg, Canada

[73] Assignee: Stac-Pac Technologies Inc., Christchurch, Barbados

[21] Appl. No.: 08/975,037

[22] Filed: Nov. 18, 1997

[51] Int. Cl.[7] ..... B65B 1/24; B65B 63/04

[52] U.S. Cl. ..... 53/429; 53/436; 493/410; 493/413; 206/494

[58] Field of Search ..... 53/429, 116, 117, 53/434, 435, 513, 520, 157; 206/494, 524.8; 493/413, 414, 415, 410, 411, 437, 448, 439, 440, 357, 356, 363

[56] References Cited

U.S. PATENT DOCUMENTS

| | | | |
|---|---|---|---|
| 32,761 | 7/1861 | Elliot . | |
| 1,463,918 | 8/1923 | Borroughs . | |
| 1,985,676 | 12/1934 | Hand . | |
| 3,245,680 | 4/1966 | Harrison et al. | 493/413 |
| 3,351,992 | 11/1967 | Carter | 53/429 |
| 3,673,757 | 7/1972 | Willis | 53/429 |
| 3,684,275 | 8/1972 | Schweitzer et al. | 493/413 X |
| 3,729,367 | 4/1973 | Shore et al. | 53/429 |
| 3,739,544 | 6/1973 | Hanemann . | |
| 4,097,039 | 6/1978 | Fischer | 493/413 |
| 4,201,029 | 5/1980 | Lerner et al. | 53/429 |
| 4,240,854 | 12/1980 | Massey et al. | 53/429 X |
| 4,418,514 | 12/1983 | Spann | 53/434 X |
| 4,427,404 | 1/1984 | Yamada . | |
| 4,499,707 | 2/1985 | Desjobert et al. . | |
| 4,547,184 | 10/1985 | Bunch, Jr. . | |
| 4,597,748 | 7/1986 | Wolf . | |
| 4,603,817 | 8/1986 | O'Connor . | |
| 4,716,706 | 1/1988 | Boeckmann . | |
| 4,846,454 | 7/1989 | Parkander . | |
| 4,896,475 | 1/1990 | McAvinew | 53/117 |
| 4,941,374 | 7/1990 | Focke | 53/157 X |
| 5,064,179 | 11/1991 | Martin . | |
| 5,087,140 | 2/1992 | Keeton et al. . | |
| 5,104,366 | 4/1992 | Bunch | 493/414 X |
| 5,177,934 | 1/1993 | Yamamoto | 53/434 X |
| 5,290,226 | 3/1994 | Green, Jr. . | |
| 5,529,564 | 6/1996 | Hediger . | |

FOREIGN PATENT DOCUMENTS

| | | | |
|---|---|---|---|
| B-22983/83 | 3/1986 | Australia . | |
| 47638 | 3/1982 | Japan | 53/116 |
| 2-182666 | 7/1990 | Japan . | |
| 1555205 | 4/1990 | U.S.S.R. | 53/429 |

*Primary Examiner*—Linda Johnson

*Attorney, Agent, or Firm*—Oliff & Berridge, PLC; Adrian D. Battison

[57] ABSTRACT

A package of a continuous strip of material includes a plurality of parallel side by side stacks each containing a length of the strip which is folded back and forth such that each folded portion of the stack is folded relative to the next portion about a line transverse to the strip and such that the side edges of the strip portions are aligned. The strip is continuous through each stack and is connected by a splice from the end of one stack to beginning of the next stack. The package is compressed to reduce the height of the stacks and maintained in the compressed condition by an evacuated sealed bag. The fold lines in the package are marked by a machine readable marking so that the strip portions from the package can be cut into strip elements with the cut lines being arranged at the fold lines.

15 Claims, 4 Drawing Sheets

PACKAGING A STRIP OF MATERIAL BY FOLDING

This application is related to a application on this subject matter Ser. No. 08/876402 filed Jun. 16th, 1997, now U.S. Pat. No. 5,921,064, and to a second application Ser. No. 08/878826 filed Jun. 19$^{th}$, 1997. This application is also related to application Ser. No. 08/906291 filed Aug. 5$^{th}$, 1997, now abandoned, application Ser. No. 08/939815, now U.S. Pat. No. 5,956,926, Ser. No. 08/939444, now abandoned and Ser. No. 08/939881, now abandoned all filed Sep. 29$^{th}$, 1997 and application Ser. No. 08/948258 filed Oct. 9$^{th}$, 1997. The disclosure of each of the above applications is incorporated herein by reference.

This invention relates to a package of a continuous strip of material in which the strip is folded back and forth and to a method of forming separate sheets using the package.

BACKGROUND OF THE INVENTION

Strips of material are used for manufacture of diapers and other absorbent products. The strips are cut on the manufacturing line at longitudinally spaced transverse cut lines to divide the strip into individual sheet elements each used in the manufacture of a respective absorbent product. Other products are also manufactured which require sheet elements cut from strips of a material other than of the above non-woven fibrous material. The present invention is therefore directed not only to absorbent products but also to any other material which can be formed from strips as set out hereinafter. Such strips may not be compressible.

As disclosed in application No. 08/948258 above, sometimes these strips are also die cut to provide different widths for shaping of the products to better match the body of the user and for better aesthetics.

However in most constructions the strip is of constant width and of a constant construction along its length. The cuing action can therefore occur at any position along the length of the strip and depends solely upon the length of the sheet element required.

The present invention is concerned with strips for cutting into individual sheet elements whether the strip is constant along its length or whether it has variations in width or other feature which identify the locations of the individual sheets to be cut from the strip.

The strip for cutting into individual sheets is conventionally supplied from a roll of the strip since rolling of the strip forms a package in which the strip has little or no distortion which could interfere with the proper formation of the strip into the sheet elements or the proper performance of the sheet elements in the finished product.

Previously packages of a continuous strip of material have been formed using a technique known as "festooning" in which the strip is folded back and forth to lay a series of strip portions back and forth with each portion being folded relative to the next about a line transverse to the strip. The technique of festooning has been available for many years and is used in packaging many different types of materials but particularly material of a fibrous nature such as fabric, non-woven strips and the like. In this technique, the strip is conventionally guided into a receptacle such as a cardboard box while a first reciprocating movement causes portions of the strip to be laid across the receptacle and folded back and forth and a second reciprocating movement causes the positions of the portions to be traversed relative to the receptacle transversely to the portions. Normally the receptacle comprises a rigid rectangular container at least partly of cardboard having a base and four upstanding sides.

The above applications disclose a new technique for packaging a strip in which the strip is folded back and fort to form stacks of the strip.

However both the conventional festooning technique and the improved technique have some possibility of compromising the performance of the strip at the fold lines which are essential to the package structure. The performance may be compromised by crushing a compressible material, by creasing a stiff or plastic material or simply by providing a visible fold line which detracts from the visual appearance of the finished product

SUMMARY OF THE INVENTION

It is one object of the present invention, therefore, to provide an improved package structure of a strip of material in which the strip is folded back and forth at longitudinally space fold lines in which the fold lines are arranged such that they are prevented from compromising the performance of a finished product using the strip.

According to one aspect of the invention there is provided a package of a strip of sheet material comprising:

a package body having two opposed first sides, two opposed second sides and two opposed ends;

a strip of material having a first side edge, a second side edge defining a width therebetween, a first surface and a second surface;

the strip being repeatedly folded back and forth to form a plurality of folded strip portions of the strip, with each folded strip portion of the strip being folded relative to one next adjacent folded strip portion about a first fold line transverse to the strip and relative to a second next adjacent folded strip portion about a second fold line transverse to the strip and spaced from the first fold line;

the portions thus forming a plurality of first fold lines arranged at one of two opposed first sides of the package and a plurality of second fold lines arranged at the other of the first sides;

the strip being traversed across the package from one of the first sides to the other of the first sides;

wherein there is provided on the strip a series of machine readable applied markings each located at a longitudinal location on the strip which is arranged to identify a longitudinal location of a respective one of the fold lines.

Preferably each applied marking is longitudinally offset from the respective fold line.

Preferably the applied markings are longitudinally offset from the respective fold lines by a predetermined longitudinal distance where the offset distance is equal for each of the markings.

Preferably the applied markings are formed by an ink layer applied onto the strip.

Preferably the folded strip portions have the side edges thereof dirty aligned with those of others of the folded strip portions.

According to a second aspect of the invention there is provided a method of forming a plurality of separate sheet elements comprising:

providing a package of a tip of sheet material for use in forming the plurality of separate sheet elements having a package body with two opposed first sides, two opposed second sides and two opposed ends and being formed from a strip of material having a first side edge, a second side edge defining a width therebetween, a first surface and a second surface;

arranging the strip to form a plurality of the sheet elements arranged end to end such that the strip can be cut at a plurality of longitudinally spaced transverse cut lines of the strip for separation of the strip into the individual sheet elements;

folding the strip repeatedly back and forth to form a plurality of folded strip portions of the strip, with each folded strip portion of the strip being folded relative to one next adjacent folded strip portion about a first fold line transverse to the strip and relative to a second next adjacent folded strip portion about a second fold line transverse to the strip and spaced from the first fold line;

the portions thus forming a plurality of first fold lines arranged at one of two opposed first sides of the package and a plurality of second fold lines arranged at the other of the first sides;

the strip thus being traversed across the package from one of the first sides to the other of the first sides;

applying to the strip a series of longitudinally spaced machine readable markings each arranged at a location to identify the longitudinal location of a respective one of the fold lines;

unfolding the strip from the package;

scanning the strip to locate the machine readable markings;

and cutting the strip by using the machine readable markings to locate cut lines transverse to the strip at or adjacent the fold lines such that the fold lines are arranged sufficiently close to an end of the sheet elements to avoid compromising the performance of the sheet elements.

According to a third aspect of the invention there is provided a method of forming a plurality of separate sheet elements comprising:

providing a package of a strip of sheet material for use in forming the plurality of separate sheet element having a package body with two opposed first sides, two opposed second sides and two opposed ends and being formed from a strip of material having a first side edge, a second side edge defining a width therebetween, a first surface and a second surface;

arranging the strip to form a plurality of the sheet elements arranged end to end such that the strip can be cut at a plurality of longitudinally spaced transverse cut lines of the strip for separation of the strip into the individual sheet elements;

folding the strip repeatedly back and forth to form a plurality of folded strip portions of the strip, with each folded strip portion of the strip being folded relative to one neo adjacent folded strip portion about a first fold line transverse to the strip and relative to a second next adjacent folded strip portion about a second fold line transverse to the strip and spaced from the first fold line;

the portions thus forming a plurality of first fold lines arranged at one of two opposed first sides of the package and a plurality of second fold lines arranged at the other of the first sides;

the strip thus being traversed across the package from one of the first sides to the other of the first sides;

applying to the strip a series of longitudinally spaced machine readable markings each arranged at a location to identify the longitudinal location of a respective one of the cut lines;

unfolding the strip from the package;

scanning the strip to locate the machine readable markings;

and, by using the machine readable markings to locate cut lines transverse to the strip, cutting each folded strip portion of the strip into a whole number of the sheet elements with two of the cut lines of each folded strip portion being located at or adjacent respective ones of the fold lines of the respective folded strip portion such that the fold lines are arranged sufficiently close to an end of the sheet elements to avoid compromising the performance of the sheet elements.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
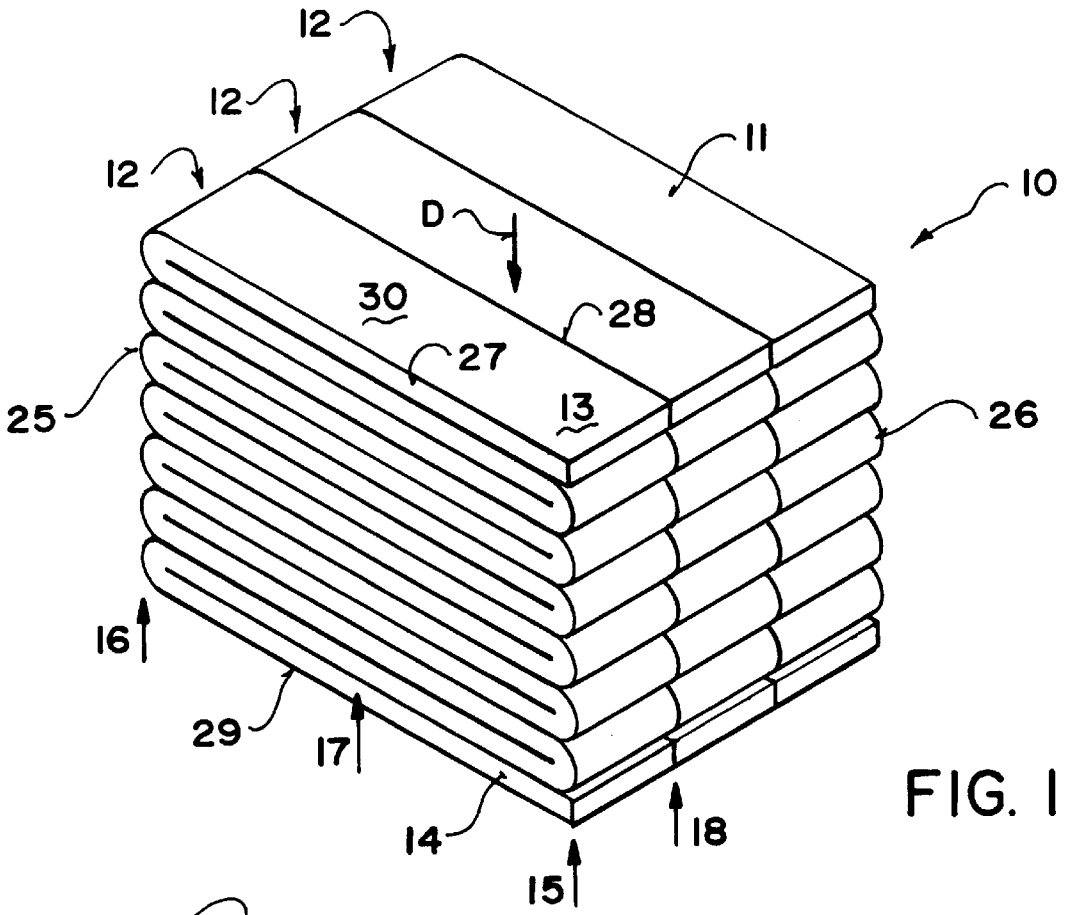
FIG. 1 is a schematic isometric view of a package of a continuous strip according to the present invention, the package including a plurality of layers of the strip.
Figure 2:
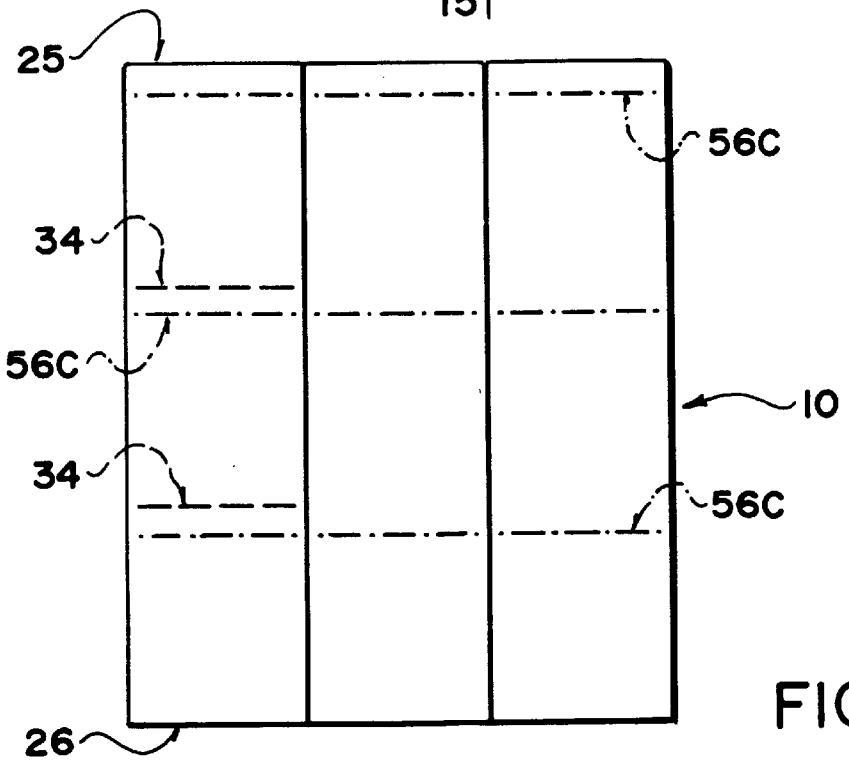
FIG. 2 is a top plan view of the package of FIG. 1.

As shown in FIGS. 1 and 2, the package comprises a generally rectangular body 10 formed from a strip 11 of a material to be packaged. In some cases this material will be of a fibrous nature formed by woven or non-oven material although this is not essential to the package structure. Many materials of various thicknesses can be packaged using the festooning technique provided they can accept, without breaking, the creasing necessary at the end of each portion.

Each package body includes at least one layer of the strip, also referred to herein as a stack, which comprises a plurality of folded strip portions of the strip which are laid on top of one another. Thus as shown in FIG. 1 the portions are folded back and forth at respective end fold lines 25 and 26 so that the fold lines lie in a common vertical plane defining the first sides 15 and 16 of the package. Each portion of the strip lies directly on top of the previous portion so that side edges 27 and 28 of the portions of the strip define a first set of lines in the common plane at right angles to the strip portions which contain all the side edges 27 of the layer and similarly, the side edges 28 of the strips of the layers define a second set of lines in the common plane at right angles to the strip portions which contain all the side edges 28 of the layers.

Thus the package is formed by laying the portions each on top of the next from a bottom portion 29 up to a top portion 30 to form the layer or stack. The package is thus formed from a plurality of layers 12 each of which has a length equal to that of the other layers and therefore equal to that of the package and the layers are formed up to a common height which is therefore equal to the height of the package. Each layer has a top end 13, a bottom end 14, two first sides 15 and 16 which are opposed and two second sides 17 and 18 which are opposed.

It will of course be appreciated that the dimensions of the package can be varied in according to the requirements so that the number of layers can be increased or decreased, the length and height of each layer can be varied to increase the number of folded strip portions and to increase the length of the folded strip portions. The package can be oriented at right angles to the arrangement shown by lying the sacks or layers of strips on one side. In addition, the stacks or layers can be formed in a different orientation from that shown.

As best shown in FIG. 2 in the plan view of the strips, the strips of each layer are folded back and forth from the fold lines 25 to the fold lines 26 to form a folded strip portion having a length equal to the distance between the fold lines.

In the example shown, the strip is intended for manufacturing diapers or similar products which are formed each from a repective sheet element cut from the length of the strip. Each sheet element in the example shown has an intended cut line 34 at which it is intended to be separated from the next sheet element.

It will be appreciated that in the package structure as shown, no cutting of the strips in the transverse direction has yet occurred and the cut lines 34 are in effect imaginary lines. In some constructions in which the strips vary along their length, the position of the cut lines can however be determined by the design of the sheet elements and the position along the length of the strip which forms the beginning and end of the sheet elements. In other arrangements, the strip is constant so that the position of the cut line is determined solely by a predetermined required length. The sheet elements are in effect thus arranged end to end so that each is separated, as shown and described hereinafter, from the next simply by cutting along the intended cut line.

It will be noted therefore from FIG. 2 that each folded strip portion of each of the package bodies is defined by an exact whole number of sheet elements. In the example shown the number of sheet elements is three but this can of course be varied from a minimum of one up to a maximum which depends solely upon to maximum allowable size of the transportable package structure. In most cases it is preferred that the folded strip portion will contain more than one sheet element since the sheet elements are often of the order of six inches to two feet in length and the required package structure will be generally significantly larger than this and certainly of the order of four feet in length.

The fact that each folded strip portion contains an exact whole number of sheet elements ensures that the cut lines occur substantially directly at the fold lines. Thus there are no fold lines across the strip in a central part of the sheet elements after the sheet elements are cut along the cut lines. This is extremely important in that the absence of fold lines in the material of the sheet elements will avoid compromising the performance or absorbency of the sheet element in the main body or central area of the sheet element.

The package may be wrapped by a flexible packaging material preferably of heat sealable non-permeable plastics which encompasses the whole of the package. The packaging material forms a sealed package which may allow air to be extracted from the package and this vacuum action can be used, when packaging material which can be compressed, with physical compression from the sides 16 and 17 of the package so as to compress the package to a reduced height in a vacuum packaging system. The amount of compressions if any, can be determined so as to minimize the volume of the package without interfering with the required loft of the product when withdrawn from the package. In this way the package structure avoids the necessity for rigid sides of a box or similar container so the package structure is stable due to the compression of the layers to reduce the height of the layers and due to the pressure of each layer against the sides of the next adjacent layers.

Compression of the package is only possible in the direction D which is at right angles to the surfaces of the portions of the strip. This acts to compress the thickness of the portions so that the dimension of each layer in the direction D is reduced by that compression. Compression along the portions or at right angles to the layers is not possible since this will act to distort the strip. Mechanical compression therefore of the package in the direction D thus reduces the dimension of the package in that direction allowing the air to be withdrawn from the flexible packaging material causing the packaging material to be pulled down onto the package to maintain it in its compressed condition and to apply pressures tending to hold the layers in intimate contact. Further detail of the packaging and compression arrangement are shown in the above applications.

The strip of each layer is connected to the next by a traverse or spliced portion of the strip which extends from one layer to the next so as to form a continuous strip through the full length of the package. The technique for connecting the strip of each layer to the next layer is shown and described in more detail in the above applications.

Figure 3:
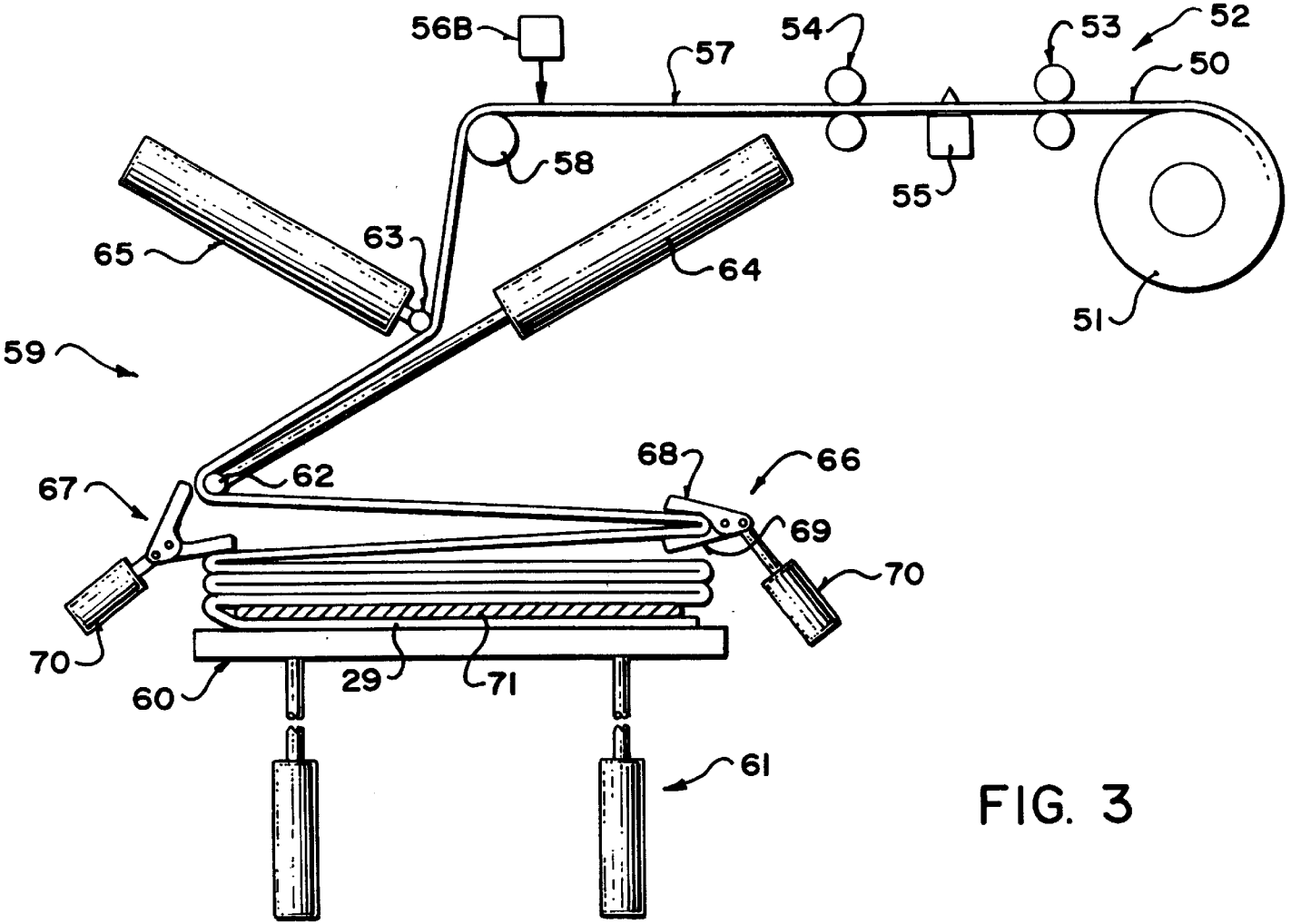
FIG. 3 is an end elevational view of an apparatus and method for forming the package of FIG. 1.
Figure 4:
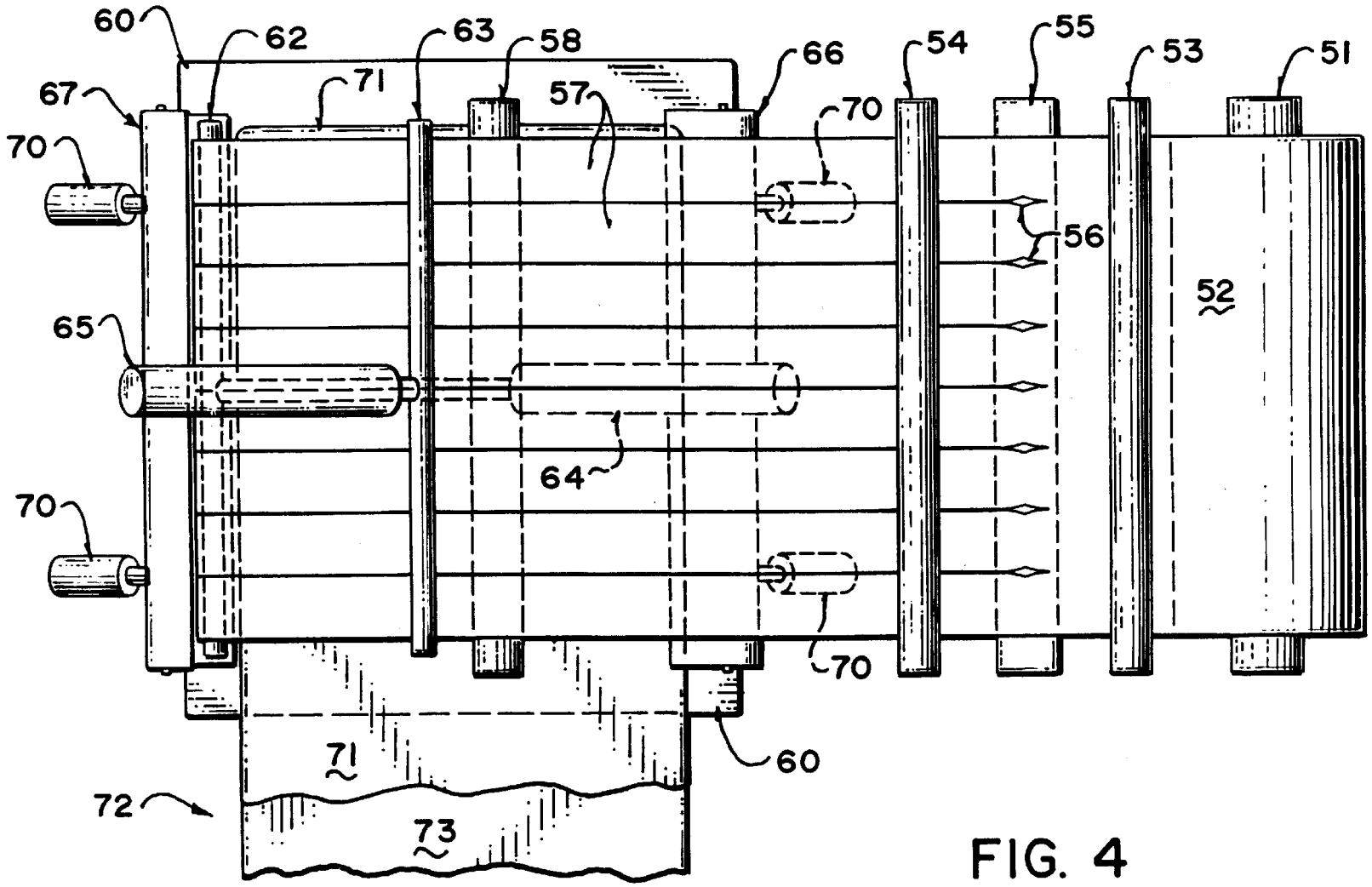
FIG. 4 is a top plan view of the apparatus of FIG. 5.

Turning now to FIGS. 3 and 4, a technique for forming the package structure is shown in more detail. A web 50 is supplied on a master roll 51 and is unwound from the master roll by a feeding and guide system 62 including two nip roller pairs 53 and 54. A slitting system 55 is mounted transversely to the web for dividing the web into a plurality of parallel side by side strips. This can be provided a by a slitter bar which carries a plurality of slitter knives at transversely spaced positions so as to slit the web into a plurality of strips 57 which are carried forwardly by the guide system 52 so that they are maintained in the common plane of the web and are maintained edge to edge.

Figure 5:
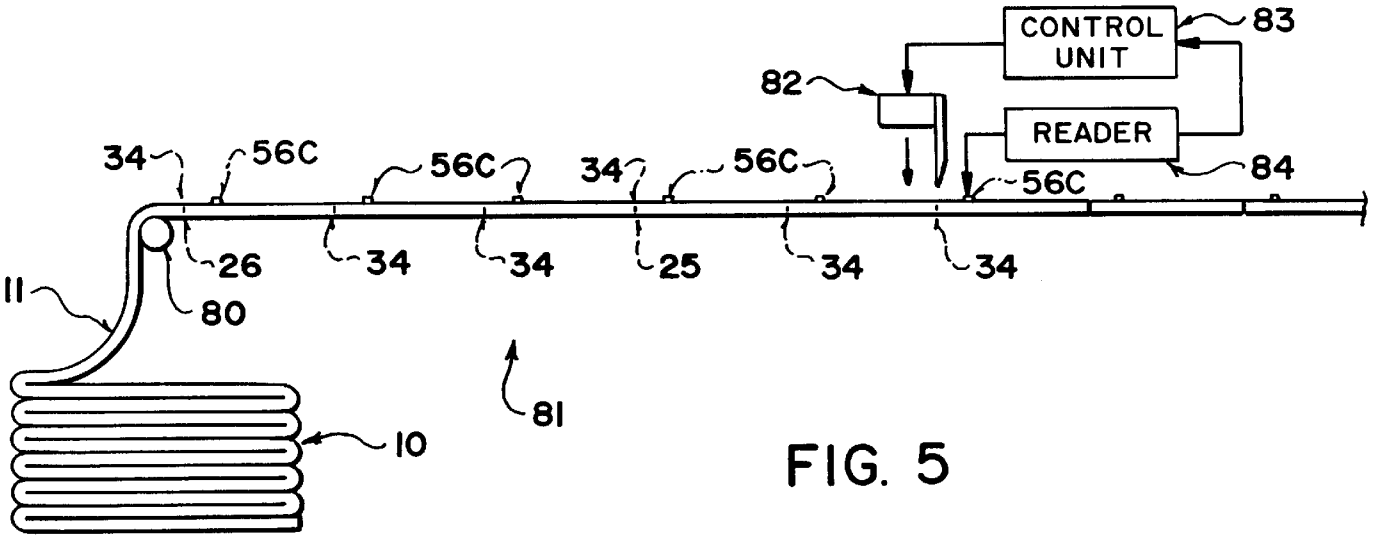
FIG. 5 is a schematic side elevational view of a manufacturing line for cutting the strip into sheets.

The strips 57 are fed over a guide roller 58 into a folding system generally indicated at 59 located underneath the feed roller 58. The folding system 59 comprises a support table 60 having a width sufficient to receive the full width of the web 50 when stretched out as shown in FIG. 5, that is the strips in side by side arrangement. The support table 60 has a length sufficient to receive the portions of the folded strips in the structure as previously described. The table 60 is mounted upon a jacking system 61 which is shown only shematically and acts to raise and lower the table so that the table is gradually lowered as the strips are folded onto the table.

The folding system further includes a pair of folding bars 62 and 63 which act to fold the strips back and forth across the table 60. The folding bar 62 is mounted on an actuating cylinder 64 and similarly the folding bar 63 is mounted on an actuating cylinder 65. In FIG. 3, the folding bar 63 is shown in the retracted position and the folding bar 62 is shown in the extended position. The folding bars move alternately between these positions so that the folding bar 62 is firstly retracted and then the folding bar 63 is extended so as to move the strips across the table to form the overlying portions of the strip previously described. The folding bars 62 and 63 extend across the full width of the web so as to engage all of the strips simultaneously and to move those strips simultaneously into the folded positions. The strips thus remain in the above described position as they are being folded. The folding bars 62 and 63 may be in the form of rollers to allow the material to pass over the bar without friction while the material is being pushed by the bar to the required position on the table. The mounting system for supporting the cylinders is not shown for convenience of illustration and this will of course be well apparent to one skilled in the art The folding system further includes a pair of creasing jaws 66 and 67 each arranged at the end of the stroke of a respective one of the folding bars. The creasing jaws also extend across the full width of the web and comprise a pair of jaw elements 68 and 69 which can be moved from an open position as indicated on the left and a closed creasing position as indicated on the right. The jaws are moved between these positions by an actuating cylinder 70 timed in relation to the operation of the cylinder 64 and 65. In addition to the opening and closing movement, the creasing jaws also move inwardly and outwardly in a horizontal direction relative to the table so as to release each fold or crease line after it is formed to allow that layer and the fold at the end of the layer to be dropped onto the previous layers and to move downwardly with the table 60. Thus as illustrated, the creasing jaw 66 at the completion of the crease moves outwardly away from the crease or fold line and at the same time opens slightly to release the fold between the two portions to drop downwardly onto the underlying portions. The jaws then open and move back inwardly ready to receive the portion of the strips wrapped around the folding bar and to grasp those as they are released from the folding bar as shown at the creasing jaw 67 in FIG. 4. This compound motion can be effected by suitable mechanical linkage operated by the actuating cylinder 70, this arrangement again being well apparent to one skilled in this art.

The strips are therefore simultaneously laid down in portions folded back and forth on top of one another to simultaneously form a plurality of the layers of the package structure. Each layer is thus formed by a single respective one of the strips. The strip is continuous throughout the layer. In order to provide a continuous strip, one or more master rolls may be spliced into the supply with the splice being formed across the width of the web so that each slit strip also acts to slit through the splice.

The back and forth folding of the strips into the layers is continued until sufficient of the portions are applied to the layer to complete the layer in accordance with the required dimensions of the layer.

Figure 6:
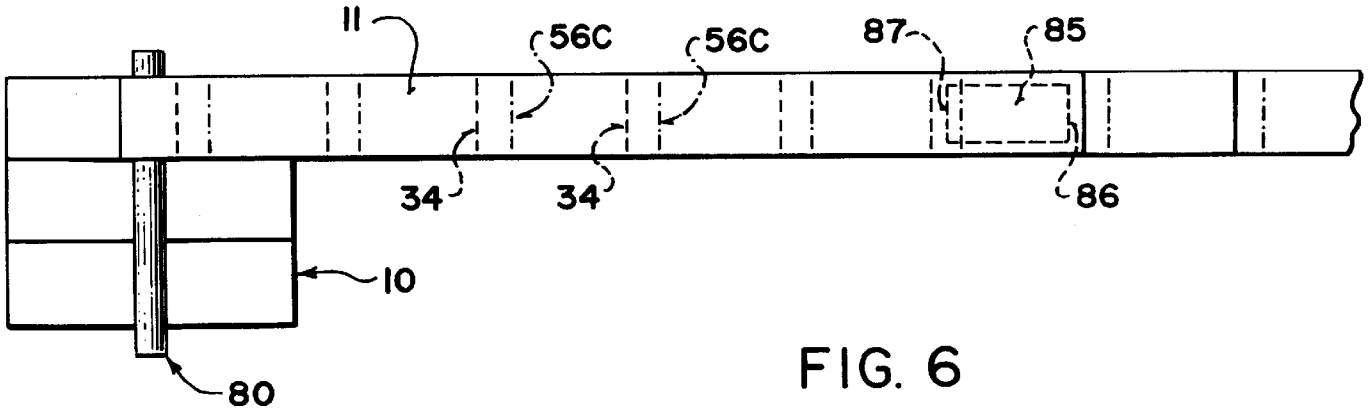
FIG. 6 is a top plan view of the line of FIG. 5.

A marker 56B is located adjacent the packaging system 59 for applying a machine readable marking 56C on the strip in registration with the intended cutting lines for dividing each sheet element from the next the markings shown as a chain dot line in FIGS. 2 and 6 can comprise an ink jet marking, possibly in the form of a dot or square, visible both to the eye and to the machine or in some cases just to the machine. The marking may or may not be located directly at the cut line depending upon the location of the machine reader relative to the cutting blade and in the example shown, the marking is located in advance of the intended line. The marking may extend only across a short part of the width of the strip. It will be appreciated that as the markings are registered with respective ones of the cut lines, each marking is offset from its associated cut line by the same distance. In an arrangement in which only the fold lines are marked by the ink jet markings, there will be only one marking on each strip portion. In an arrangement in which the number of sheet elements on each strip portion is a whole number greater than one, each intended cut line can be marked and therefore there will be a plurality of markings on each strip portion.

Turning now to FIGS. 5 and 6, there is shown schematically the unfolding and cutting line for using the strip and separating the strip into the separate sheet elements. Thus the package is indicated at 10 and the strip is withdrawn from the package over a guide member 80 for directing into an operating line 81. A cutting device 82 is operated by a control unit 83 which receives registration information from the markings 56C as read by a reader 84. Thus the markings are located at a position to operate the control device to effect cutting at the intended cut line.

As explained previously, some of the cut lines are located at the fold lines. Depending upon tolerances, the cut may not be effected directly at the fold line but may deviate slightly therefrom. As the sheet elements are often intended to be stitched or otherwise formed into a final product, with edges of the sheet element thus being formed into edges of the final product, the cut line can deviate from the fold line by a small amount provided the fold line does not end up in a central absorbent area 85 of the final product, indicated by dash lines 86, 87. That is the fold lines are arranged sufficiently close to an end of the sheet elements to avoid compromising the performance of the sheet elements.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A package of a strip of sheet material comprising:

a strip of material having a first side edge, a second side edge defining a width therebetween, a first surface and a second surface, and the strip being continuous along its length and including no lines of weakness;

the strip being folded into a stack having two opposed first sides, two opposed second sides and two opposed ends;

the strip being repeatedly folded back and forth to form a plurality of folded strip portions of the strip, with each folded strip portion of the strip being folded relative to one next adjacent folded strip portion about a first fold line transverse to the strip and relative to a second next adjacent folded strip portion about a second fold line transverse to the strip and spaced from the first fold line;

the strip portions thus forming a plurality of first fold lines arranged at one of two opposed first sides of the package and a plurality of second fold lines arranged at the other of the first sides;

the strip being traversed across the package from one of the first sides to the other of the first sides;

the strip being continuous through the stack from an uppermost strip portion of the stack to a lowermost strip portion of the stack;

wherein there is provided on the strip in the stack a series of machine readable applied markings that identify fold lines so that the strip can be cut at the fold lines into a plurality of sheet elements.

2. The package according to claim 1 wherein each applied marking is arranged on the strip at a position which is longitudinally offset from the respective fold line.

3. The package according to claim 1 wherein the strip portions are folded into the stack such that the strip portions of the stack have the side edges thereof directly aligned.

4. A method of forming a plurality of separate sheet elements comprising:

providing a strip of sheet material for use in forming the plurality of separate sheet elements the strip having a first side edge, a second side edge defining a width therebetween, a first surface and a second surface, and the strip being continuous along its length;

folding the strip to form the strip into a stack having two opposed first sides, two opposed second sides and two opposed ends;

the strip being folded repeatedly back and forth to form a plurality of folded strip portions of the strip, with each folded strip portion of the strip being folded relative to one next adjacent folded strip portion about a first fold line transverse to the strip and relative to a second next adjacent folded strip portion about a second fold line transverse to the strip and spaced from the first fold line, the strip being continuous along its lent and throughout the stack from a top strip portion to a bottom strip portion;

the strip portions thus forming a plurality of first fold lines arranged at one of two opposed first sides of the package and a plurality of second fold lines arranged at the other of the first sides;

the strip thus being traversed across the package from one of the first sides to the other of the first sides;

the strip having applied thereto a series of longitudinally spaced machine readable markings each arranged at a location to identify the longitudinal location of a cut line;

unfolding the continuous strip from the stack;

scanning the continuous strip after unfolding to locate the machine readable markings thereon;

and cutting the unfolded continuous strip by using the machine readable markings to locate cut lines transverse to the strip at or adjacent the fold lines such that the fold lines are arranged sufficiently close to an end of the sheet elements to avoid compromising the performance of the sheet elements.

5. The method according to claim 4 wherein each applied marking is arranged on the strip at a position which is longitudinally offset from the respective fold line.

6. The method according to claim 4 wherein the strip portions are folded into the stack such that the strip portions of the stack have the side edges thereof directly aligned.

7. A method of forming a plurality of separate sheet elements comprising:

providing a strip of sheet material for use in forming the plurality of separate sheet elements, the strip having a first side edge, a second side edge defining a width therebetween, a first surface and a second surface;

folding the strip to form the strip into a stack having two opposed first sides, two opposed second sides and two opposed ends;

the strip being folded repeatedly back and forth to form a plurality of folded strip portions of the strip, with each folded strip portion of the strip being folded relative to one next adjacent folded strip portion about a first fold line transverse to the strip and relative to a second next adjacent folded strip portion about a second fold line transverse to the strip and spaced from the first fold line;

the strip portions thus forming a plurality of first fold lines arranged at one of two opposed first sides of the package and a plurality of second fold lines arranged at the other of the first sides;

the strip thus being traversed across the package from one of the first sides to the other of the first sides;

the strip being continuous through the stack from a top strip portion to a bottom strip portion;

the strip having applied thereto a series of longitudinally spaced machine readable markings positioned to identify the longitudinal location of the cut lines;

unfolding the continuous strip from the stack;

scanning the continuous strip after unfolding to locate the machine readable markings;

and, by using the machine readable markings to locate cut lines transverse to the strip, cutting the strip into sheet elements with some of the cut lines being located at or adjacent respective ones of the fold lines such that the fold lines are arranged sufficiently close to an end of the sheet elements to avoid compromising the performance of the sheet elements and others of the cut lines being located intermediate the fold lines such that each strip portion between two fold lines is cut into a whole number greater than one of the sheet elements.

8. The method according to claim 7 wherein each applied marking is arranged on the strip at a position which is longitudinally offset from the respective cut line.

9. The method according to claim 7 wherein the strip portions are folded into the stack such that the strip portions of the stack have the side edges thereof directly aligned.

10. The package according to claim 1 further comprising a plurality of strips, each strip folded to form one of a plurality of stacks, wherein the stacks are positioned side by side.

11. The package according to claim 1 wherein each of the folded strip portions has at least two markings longitudinally offset from each other to define at least two sheet elements on each folded strip portion.

12. The package according to claim 1 further comprising flexible packaging material disposed around the stack to form a compressed, sealed package.

13. The package according to claim 1 wherein the no lines of weakness of the strip include no transverse lines of weakness.

14. The method according to claim 6 wherein the strips are folded to form a plurality of stacks arranged side by side.

15. The method according to claim 9 wherein the strips are folded to form a plurality of stacks arranged side by side.

* * * * *